US006577059B2

(12) United States Patent
Shirakawa et al.

(10) Patent No.: US 6,577,059 B2
(45) Date of Patent: Jun. 10, 2003

(54) THIN-FILM EL DEVICE, AND ITS FABRICATION PROCESS

(75) Inventors: Yukihiko Shirakawa, Chuo-ku (JP); Masashi Miwa, Chuo-ku (JP); Katsuto Nagano, Chuo-ku (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/866,718

(22) Filed: May 30, 2001

(65) Prior Publication Data

US 2002/0105264 A1 Aug. 8, 2002

(30) Foreign Application Priority Data

Nov. 17, 2000 (JP) ..... 2000-351859

(51) Int. Cl.[7] ..... H05B 33/22
(52) U.S. Cl. ..... 313/506; 313/509; 427/66
(58) Field of Search ..... 313/503, 506; 428/690, 917; 315/169.3; 427/58, 66

(56) References Cited

U.S. PATENT DOCUMENTS 4,870,322 A * 9/1989 Matsudaira et al. ..... 313/506
5,336,965 A * 8/1994 Meyer et al. ..... 313/506

FOREIGN PATENT DOCUMENTS

JP 61-250993 11/1986
JP 62-44989 2/1987
JP 7-50197 2/1995
JP 7-44072 5/1995

OTHER PUBLICATIONS

S. Tanaka, Monthly Magazine Display, pp. 1–10, "Recent Development Of Inorganic ANd Organic EL Display", Apr. 1998.

X. Wu, International Display Workshop (IDW), pp. 593–596, "Multicolor Thin–Film Ceramic Hybrid EL Displays", 1997.

* cited by examiner

*Primary Examiner*—Ashok Patel
(74) *Attorney, Agent, or Firm*—Oblon, Spivak, McClelland, Maier & Neustadt, P.C.

(57) ABSTRACT

The invention has for its object to provide a thin-film EL device comprising a multilayer dielectric layer formed of a lead-based dielectric material by a solution coating-and-firing process, which provides a solution to problems in conjunction with its light emission luminance drops, luminance variations and changes of light emission luminance with time, thereby achieving high display quality, and a process for the fabrication of the same. This is accomplished by the provision of a thin-film EL device comprising a patterned electrode stacked on an electrically insulating substrate and a dielectric layer having a multilayer structure wherein at least one lead-based dielectric layer formed by repeating the solution coating-and-firing process one or more times and at least one non-lead, high-dielectric-constant dielectric layer are stacked together, and the uppermost surface layer of the dielectric layer having such a multilayer structure is defined by the non-lead, high-dielectric-constant dielectric layer.

10 Claims, 5 Drawing Sheets

THIN-FILM EL DEVICE, AND ITS FABRICATION PROCESS

BACKGROUND OF THE INVENTION

1. Art Field

This invention relates to a thin-film EL device having at least a structure comprising an electrically insulating substrate, a patterned electrode layer stacked on the substrate, and a dielectric layer, a light-emitting layer and a transparent electrode layer stacked on the electrode layer.

2. Background Art

EL devices are now practically used in the form of backlights for liquid crystal displays (LCDs) and watches.

An EL device works on a phenomenon in which a substance emits light at an applied electric field, viz., an electro-luminescence (EL) phenomenon.

The EL device is broken down into two types, one referred to as a dispersion type EL device having a structure wherein electrode layers are provided on the upper and lower sides of a dispersion with light-emitting powders dispersed in an organic material or porcelain enamel, and another as a thin-film EL device using a thin-film light-emitting substance provided on an electrically insulating substrate and interposed between two electrode layers and two thin-film insulators. These types of EL devices are each driven in a direct or alternating voltage drive mode. Known for long, the dispersion type EL device has the advantage of ease of fabrication; however, it has only limited use thanks to low luminance and short service life. On the other hand, the thin-film EL device has recently wide applications due to the advantages of high luminance and very long-lasting quality.

The structure of a typical double-insulation type thin-film EL device out of conventional thin-film EL devices is shown in FIG. 2. In this thin-film EL device, a transparent substrate 21 formed of a green glass sheet used for liquid crystal displays or PDPs is stacked thereon with a transparent electrode layer 22 comprising an ITO of about 0.2 $\mu$m to 1 $\mu$m in thickness and having a given striped pattern, a first insulator layer 23 in a transparent thin-film form, a light-emitting layer 24 of about 0.2 $\mu$m to 1 $\mu$m in thickness and a second insulator layer 25 in a transparent thin-film form. Further, an electrode layer 26 formed of, e.g., an Al thin-film patterned in a striped manner is provided in such a way as to be orthogonal with respect to the transparent electrode layer 22. In a matrix defined by the transparent electrode layer 22 and the electrode layer 26, voltage is selectively applied to a selected given light-emitting substance to allow a light-emitting substance of a specific pixel to emit light. The resultant light is extracted from the substrate side. Having a function of limiting currents flowing through the light-emitting layer, such thin-film insulator layers make it possible to inhibit the dielectric breakdown of the thin-film EL device, and so contribute to the achievement of stable light-emitting properties. Thus, the thin-film EL device of this structure has now wide commercial applications.

For the aforesaid thin-film transparent insulator layers 23 and 25, transparent dielectric thin films of $Y_2O_3$, $Ta_2O_5$, $Al_3N_4$, $BaTiO_3$, etc. are formed at a thickness of about 0.1 to 1 $\mu$m by means of sputtering, evaporation or the like.

For light-emitting materials, ZnS with yellowish orange light-emitting Mn added thereto has mainly been used due to ease of film formation and in consideration of light-emitting properties. For color display fabrication, the use of light-emitting materials capable of emitting light in the three primary colors, red, green and blue is inevitable. These materials known so far in the art, for instance, include SrS with blue light-emitting Ce added thereto, ZnS with blue light-emitting Tm added thereto, ZnS with red light-emitting Sm added thereto, CaS with red light-emitting Eu added thereto, ZnS with green light-emitting Tb added thereto, and CaS with green light-emitting Ce added thereto.

In an article entitled "The Latest Development in Displays" in "Monthly Display", April, 1998, pp. 1–10, Shosaku Tanaka shows ZnS, Mn/CdSSe, etc. for red light-emitting materials, ZnS:TbOF, ZnS:Tb, etc. for green light-emitting materials, and SrS:Cr, $(SrS:Ce/ZnS)_n$, $Ca_2Ga_2S_4$:Ce, $Sr_2Ga_2S_4$:Ce, etc. for blue light-emitting materials as well as SrS:Ce/ZnS:Mn, etc. for white light-emitting materials.

IDW (International Display Workshop), '97 X. Wu "Multicolor Thin-Film Ceramic Hybrid EL Displays", pp. 593–596 shows that SrS:Ce out of the aforesaid materials is used for a thin-film EL device having a blue light-emitting layer. In addition, this publication shows that when a light-emitting layer of SrS:Ce is formed by an electron beam evaporation process in a $H_2S$ atmosphere, it is possible to obtain a light-emitting layer of high purity.

However, a structural problem with such a thin-film EL device remains unsolved. The problem is that since the insulator layers are each formed of a thin film, it is difficult to reduce to nil steps at the edges of the pattern of the transparent electrode, which occur when a large area display is fabricated, and defects in the thin-film insulators, which are caused by dust, etc. occurring in the process of display production, resulting in a destruction of the light-emitting layer due to a local dielectric strength drop. Such defects offer a fatal problem to display devices, and produce a bottleneck in the wide practical use of thin-film EL devices in a large-area display system, in contrast to liquid crystal displays or plasma displays.

To provide a solution to the defect problem with such thin-film insulators, JP-A 07-50197 and JP-B 07-44072 disclose a thin-film EL device using an electrically insulating ceramic substrate as a substrate and a thick-film dielectric material for the thin-film insulator located beneath the light-emitting substance. As shown in FIG. 3, this thin-film EL device has a structure wherein a substrate 31 such as a ceramic substrate is stacked thereon with a lower thick-film electrode layer 32, a thick-film dielectric layer 33, a light-emitting layer 34, a thin-film insulator layer 35 and an upper transparent electrode 36. Unlike the thin-film EL device shown in FIG. 2, the transparent electrode layer is formed on the uppermost position of the device because the light emitted from the light-emitting substance is extracted out of the upper side of the device facing away from the substrate.

The thick-film dielectric layer in this thin-film EL device has a thickness of a few tens of $\mu$m to a few hundred $\mu$m or is several hundred to several thousand times as thick as the thin-film insulator layer. Thus, the thin-film EL device has the advantages of high reliability and high fabrication yields because of little or no dielectric breakdown caused by pinholes formed by steps at electrode edges or dust, etc. occurring in the device fabrication process. The use of this thick-film dielectric layer leads to another problem that the effective voltage applied to the light-emitting layer drops. However, this problem can be solved or eliminated by using a high dielectric constant material for the dielectric layer.

However, the light-emitting layer stacked on the thick-film dielectric layer has a thickness of barely a few hundred nm that is about 1/100 of that of the thick-film dielectric layer. For this reason, the thick-film dielectric layer must have a smooth surface at a level less than the thickness of the light-emitting layer. However, it is still difficult to sufficiently smooth down the surface of a dielectric layer fabricated by an ordinary thick-film process.

To be more specific, a thick-film dielectric layer, because of being essentially constructed of ceramics using a powdery material, usually suffers from a volume shrinkage of about 30 to 40% upon closely sintered. However, ordinary ceramics are closely packed through a three-dimensional shrinkage upon sintering whereas a thick-film ceramic material formed on a substrate does not shrink across the substrate because the thick film is constrained to the substrate; its volume shrinkage occurs in the thickness direction or one-dimensionally alone. For this reason, the sintering of the thick-film dielectric layer does not proceed to a sufficient level, yielding an essentially porous layer.

Since the process of close packing proceeds through a ceramic solid phase reaction of powders having a certain particle size distribution, sintering abnormalities such as abnormal crystal grain growth and macropores are likely to occur. In addition, the surface roughness of the thick film is absolutely greater than the crystal grain size of polycrystal sintered grains and, accordingly, the thick film has surface asperities of at least sub-pm size even though it is free from such defects as mentioned above.

When the dielectric layer has surface defects or a porous structure or asperity shape as mentioned above, it is impossible to deposit thereon a light-emitting layer formed by evaporation, sputtering or the like uniformly following the surface shape thereof. This makes it impossible to effectively apply an electric field to the portion of the light-emitting layer formed on a non-flat portion of the substrate, resulting in problems such as a decrease in the effective light-emitting area, and a light emission luminance decrease due to a local dielectric breakdown of the light-emitting layer, which is caused by local non-uniform thicknesses. Furthermore, locally large thickness fluctuations cause the strength of an electric field applied to the light-emitting layer to vary too locally largely to obtain any definite light emission voltage threshold.

Thus, operations for polishing down large surface asperities of a thick-film dielectric layer and then removing much finer asperities by a sol-gel step are needed for conventional fabrication processes.

However, the polishing of a large-area substrate for display or other purposes is technically difficult to achieve, and is a factor for cost increases as well. The addition of the sol-gel step is another factor for cost increases. When a thick-film dielectric layer has abnormal sintered spots which may give rise to asperities too large for removal by polishing, yields drop because they cannot be removed even by the addition of the sol-gel step. It is thus very difficult to use a thick-film dielectric material to form a light emission defect-free dielectric layer at low cost.

A thick-film dielectric layer is formed by a ceramic powder material sintering process where elevated firing temperature is needed. As is the case with ordinary ceramics, a firing temperature of at least 800° C. and usually 850° C. is needed. To obtain a closely packed thick-film sintered body in particular, a firing temperature of at least 900° C. is needed. In consideration of heat resistance and a reactivity problem with respect to the dielectric layer, the substrate used for the formation of such a thick-film dielectric layer is limited to alumina or zirconia ceramic substrate; it is difficult to rely on inexpensive glass substrates. The requisite for the aforesaid ceramic substrate to be used for display purposes is that it has a large area and satisfactory smoothness. The substrate meeting such conditions is obtained only with much technical difficulty, and is yet another factor for cost increases.

For the metal film used as the lower electrode layer, it is required to use costly noble metals such as palladium and platinum. This, too, is a factor for cost increases.

In order to solve such problems, the inventor has already filed Japanese Patent Application No. 2000-299352 to come up with a multilayer dielectric layer thicker than a conventional thin-film dielectric layer, which is used in place of a conventional thick-film dielectric material or a thin-film dielectric material formed by a sputtering process or the like, and is formed by repeating the solution coating-and-firing process plural times.

The structure of a thin-film EL device using the aforesaid multilayer dielectric layer is shown in FIG. 4. In this thin-film EL device, a lower electrode layer 42 having a given pattern is stacked on an electrically insulating substrate 41. A multilayer dielectric layer 43 is formed on the lower electrode layer by repeating the solution coating-and-firing process plural times. A light-emitting layer 44 and preferably a thin-film insulator layer 45 and a transparent electrode layer 46 are stacked on the dielectric layer.

The multilayer dielectric layer having such structure is characterized in that as compared with a conventional thin-film dielectric layer, higher dielectric strength is achievable, locally defective insulation due to dust or the like occurring during processing is more effectively prevented, and more improved surface flatness is obtainable. For a thin-film EL device using the aforesaid multilayer dielectric layer, glass substrates more inexpensive than ceramic substrates may be used because the dielectric layer can be formed at a temperature lower than 700° C.

However, when the multilayer dielectric layer is formed by means of such a solution coating-and-firing process, the use of a lead-based dielectric material for the dielectric layer material offers some practically unfavorable problems such as initial light emission luminance drops, luminance variations, and changes of light emission luminance with time, all ascribable to the reaction of a light-emitting layer formed on the dielectric layer with a lead component of the dielectric layer.

SUMMARY OF THE INVENTION

An object of the present invention is to provide, without incurring any cost increase, a thin-film EL device which allows restrictions on the selection of substrates—which are one problem associated with a conventional thin-film EL device—to be removed so that glass substrates or the like, which are inexpensive and can be processed into a large area, can be used, and enables non-flat portions of a dielectric layer due to an electrode layer or dust or the like during processing to be corrected by a quick-and-easy process and the dielectric layer to have improved surface flatness. Especially when the invention is applied to a thin-film EL device wherein a multilayer dielectric layer is formed using a lead-based dielectric material as mentioned above, high display qualities can be obtained with no initial light emission luminance drop, no luminance variation, and no change of light emission luminance with time. The present invention also provides a process for the fabrication of such a thin-film EL device.

That is, the aforesaid object is achieved by the following embodiments of the invention.

(1) A thin-film EL device having at least a structure comprising an electrically insulating substrate, a patterned electrode layer stacked on said substrate, and a dielectric layer, a light-emitting layer and a transparent electrode stacked on said electrode layer, wherein:

said dielectric layer has a multilayer structure wherein at least one lead-based dielectric layer formed by repeating a solution coating-and-firing process once or more times and at least one non-lead, high-dielectric-constant dielectric layer are stacked together, and at least an uppermost surface layer of said dielectric layer having said multilayer structure is defined by at least one non-lead, high-dielectric-constant dielectric layer.

(2) The thin-film EL device according to (1) above, wherein said lead-based dielectric layer has a thickness of 4 $\mu$m to 16 $\mu$m inclusive.

(3) The thin-film EL device according to (1) above, wherein said non-lead, high-dielectric-constant dielectric layer is made up of a perovskite structure dielectric material.

(4) The thin-film EL device according to (1) above, wherein said non-lead, high-dielectric-constant dielectric layer is formed by a sputtering process.

(5) The thin-film EL device according to (1) above, wherein said non-lead, high-dielectric-constant dielectric layer is formed by the solution coating-and-firing process.

(6) The thin-film EL device according to (1) above, wherein said dielectric layer having said multilayer structure is formed by repeating the solution coating-and-firing process at least three times.

(7) A process for fabricating a thin-film EL device having at least a structure comprising an electrically insulating substrate, a patterned electrode layer stacked on said substrate, and a dielectric layer, a light-emitting layer and a transparent electrode stacked on said electrode layer, wherein:

at least one lead-based dielectric layer formed by repeating a solution coating-and-firing process once or more times and at least one non-lead high-dielectric-constant dielectric layer are stacked together to form a multilayer structure, and at least an uppermost surface layer of a dielectric layer having said multilayer structure is defined by a non-lead, high-dielectric-constant dielectric layer.

(8) The thin-film EL device fabrication process according to (7) above, wherein said non-lead, high-dielectric-constant dielectric layer is formed by a sputtering process.

(9) The thin-film EL device fabrication process according to (7) above, wherein said non-lead, high-dielectric-constant dielectric layer is formed by the solution coating-and-firing process.

(10) The thin-film EL device fabrication process according to (7) above, wherein said dielectric layer having said multilayer structure is formed by repeating the solution coating-and-firing process at least three times.

EXPLANATION OF THE PREFERRED EMBODIMENTS

The thin-film EL device of the invention has at least a structure comprising an electrically insulating substrate, a patterned electrode layer stacked on said substrate, and a dielectric layer, a light-emitting layer and a transparent electrode stacked on said electrode layer. The dielectric layer has a multilayer structure wherein at least one lead-based dielectric layer formed by repeating a solution coating-and-firing process once or more times and at least one non-lead, high-dielectric constant dielectric layer are stacked together, and at least the uppermost surface layer of the dielectric layer having such a multilayer structure is defined by a non-lead, high-dielectric-constant dielectric layer. The "lead-based dielectric layer" used herein is understood to refer to a dielectric material containing lead in its composition, and the "non-lead, (high-dielectric-constant) dielectric layer" used herein is understood to refer to a dielectric material containing no lead in its composition.

Figure 1:
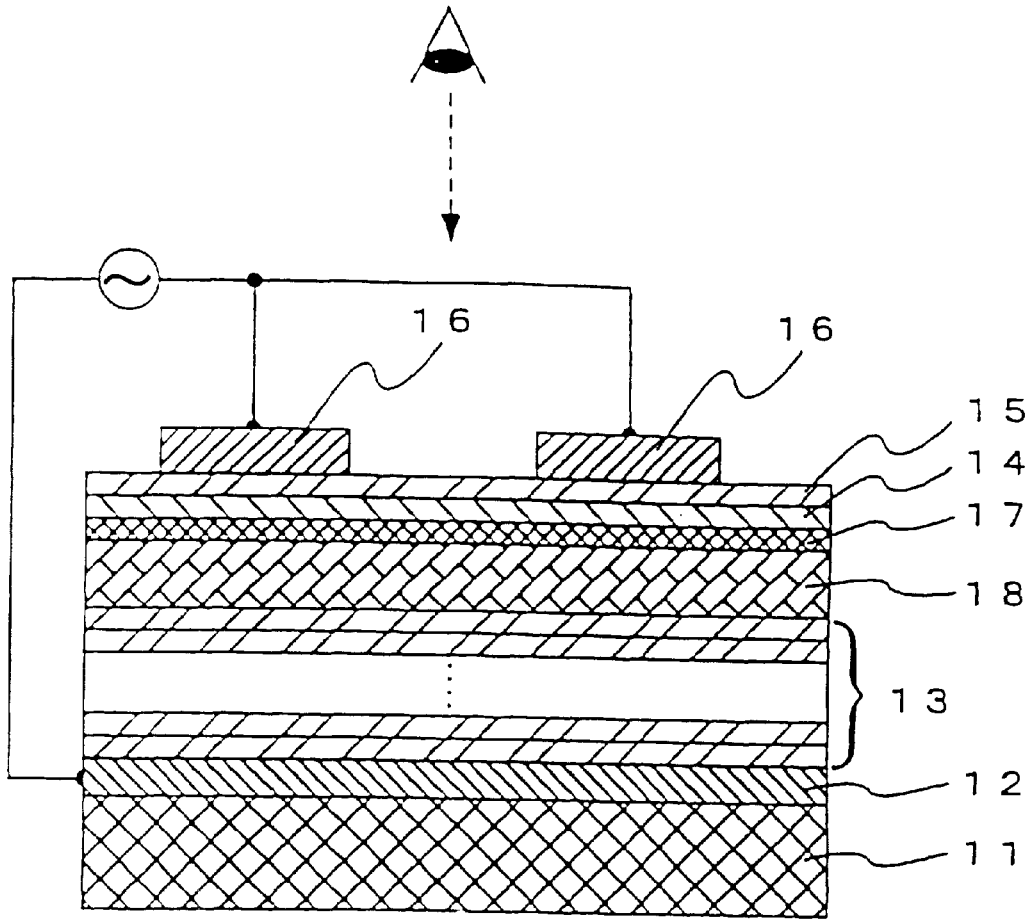
FIG. 1 is a sectional view illustrative of the structure of the thin-film EL device of the invention.
Figure 2:
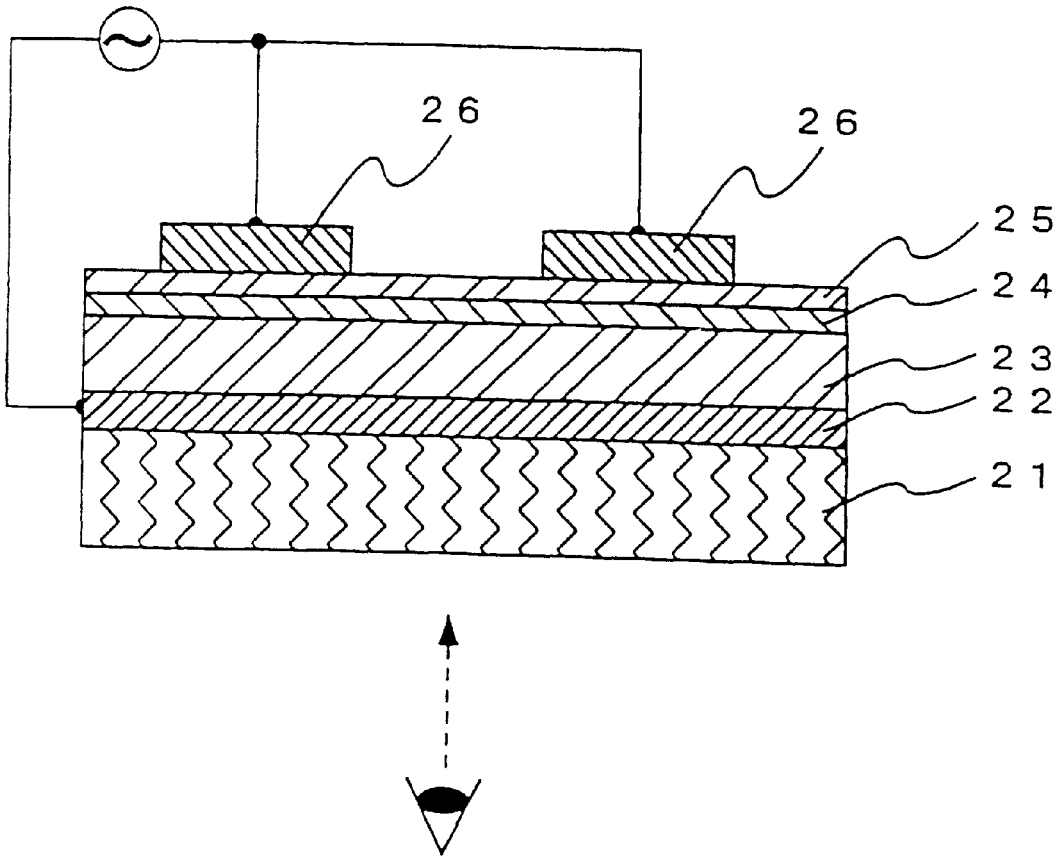
FIG. 2 PRIOR ART
FIG. 2 is a section view illustrative of the structure of one conventional thin-film EL device.
Figure 3:
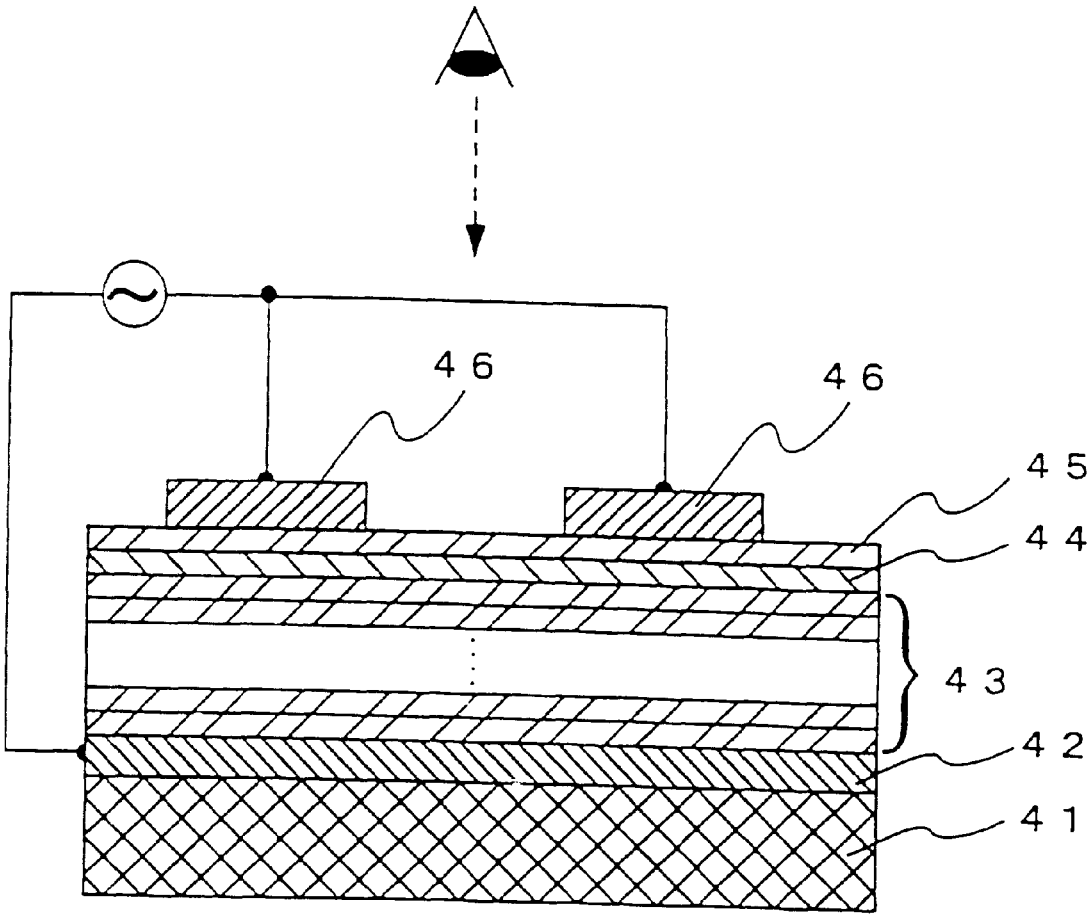
FIG. 3 PRIOR ART
FIG. 3 is a section view illustrative of the structure of another conventional thin-film EL device.
Figure 4:
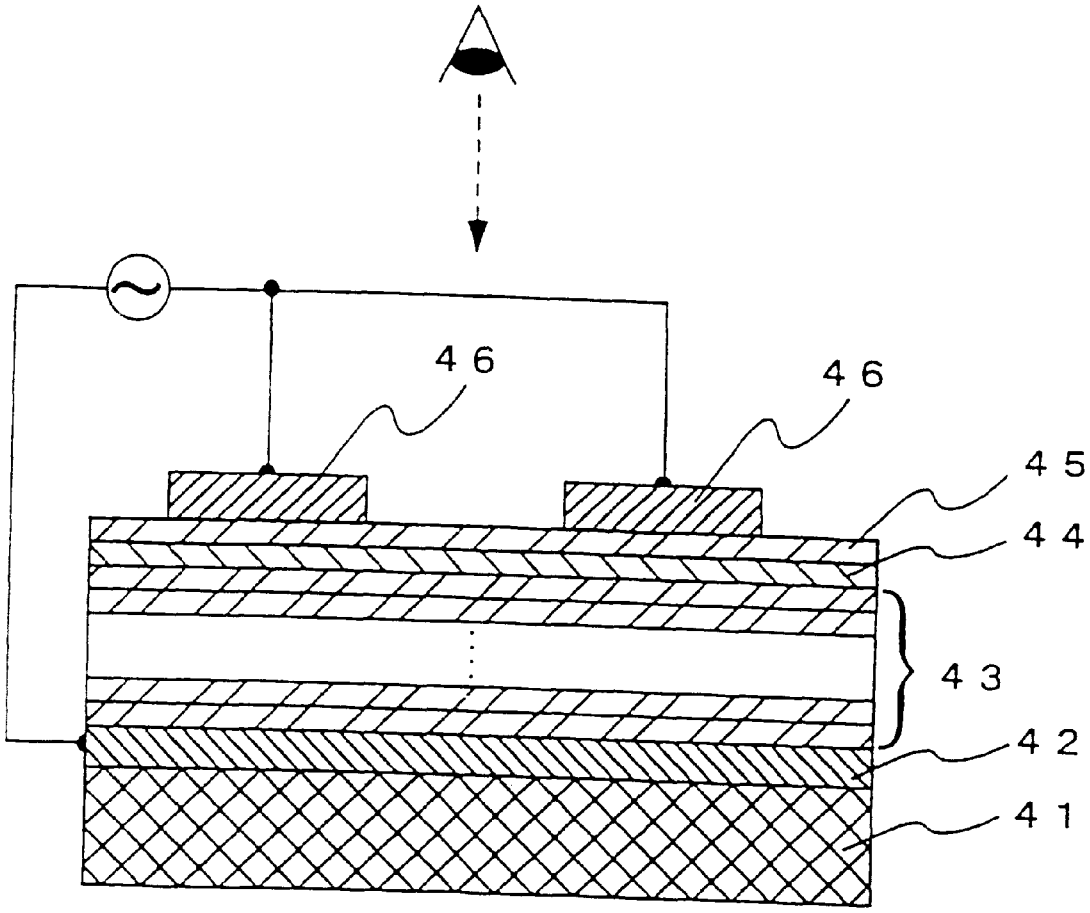
FIG. 4 PRIOR ART
FIG. 4 is a section view illustrative of the structure of yet another conventional thin-film EL device.

FIG. 1 is illustrative of the structure of the thin-film EL device according to the invention. The thin-film EL device of the invention comprises an electrically insulating substrate 11, a lower electrode layer 12 having a given pattern and a multilayer dielectric layer stacked on the lower electrode layer, wherein at least one lead-based dielectric layer 13 formed by repeating the solution coating-and-firing process once or more times and at least one non-lead, high-dielectric-constant dielectric layer 18 are stacked together in such a way that the uppermost surface layer of the dielectric layer is defined by the non-lead, high-dielectric-constant dielectric layer. Stacked on the dielectric layer are a thin-film insulator layer 17, a light-emitting layer 14, a thin-film insulator layer 17, a light-emitting layer 14, a thin-film insulator layer 15 and a transparent electrode layer 16. In this connection, the insulator layers 17 and 15 may be dispensed with. The lower electrode layer and upper transparent electrode layer are each configured in a striped fashion, and are located in mutually orthogonal directions. The lower electrode layer and upper transparent electrode layer are respectively selected and voltage is selectively applied to the light-emitting layer and sites where both electrodes cross at right angles, whereby specific pixels are allowed to emit light.

For the substrate, any desired material may be used provided that it has electrical insulating properties and maintains given heat-resistant strength without contaminating the lower electrode layer and dielectric layer formed thereon.

Exemplary substrates are ceramic substrates such as alumina ($Al_2O_3$), quartz glass ($SiO_2$), magnesia (MgO), forsterite ($2MgO.SiO_2$), steatite ($MgO.SiO_2$), mullite ($3Al_2O_3.2SiO_2$), beryllia (BeO), zirconia ($ZrO_2$), aluminum-nitride (AlN), silicon nitride (SiN) and silicon carbide (SiC) substrates, and glass substrates such as crystallized glass, high heat-resistance glass and green sheet glass substrates. Enameled metal substrates, too, may be used.

Of these substrates, particular preference is given to crystallized glass and high heat-resistance glass substrates as well as green sheet glass substrates on condition that they are compatible with the firing temperature for the dielectric layer to be formed due to their low cost, surface properties, flatness and ease of large-area substrate fabrication.

The lower electrode layer is configured in such a way as to have a pattern comprising a plurality of stripes. It is then desired that the line width define the width of one pixel and the space between lines define a non-light emission area, and so the space between lines be reduced as much as possible. Although depending on the end display resolution, for instance, a line width of 200 to 500 $\mu$m and a space of about 20 $\mu$m are needed.

The lower electrode layer should preferably be formed of a material which ensures high electrical conductivity, receives no damage during dielectric layer formation, and has a low reactivity with respect to the dielectric layer or light-emitting layer. Desired for such a lower electrode layer materials are noble metals such as Au, Pt, Pd, Ir and Ag, noble metal alloys such as Au—Pd, Au—Pt, Ag—Pd and Ag—Pt, and electrode materials composed mainly of noble metals such as Ag—Pd—Cu with base metal elements added thereto, because oxidation resistance with respect to an oxidizing atmosphere used for the firing of the dielectric layer material can be easily obtained. Use may also be made of oxide conductive materials such as ITO, $SnO_2$ (Nesa film) and ZnO—Al or, alternatively, base metals such as Ni and Cu provided that the firing of the dielectric layer must be carried out at a partial pressure of oxygen at which these base metals are not oxidized. The lower electrode layer may be formed by known techniques such as sputtering, evaporation, and plating processes.

The dielectric layer should preferably be constructed of a material having a high dielectric constant and high dielectric strength. Here let e1 and e2 stand for the dielectric constants of the dielectric layer and light-emitting layer, respectively, and d1 and d2 represent the thicknesses thereof. When voltage Vo is applied between the upper electrode layer and the lower electrode layer, voltage V2 is then given by $$V2/Vo=(e1\times d2)/(e1\times d2+e2\times d1) \quad (1)$$

Here the specific dielectric constant and thickness of the light-emitting layer are assumed to be e2=10 and d2=1 $\mu$m. Then, $$V2/Vo=e1/(e1+10\times d1)\ \ldots \quad (2)$$

The voltage effectively applied to the light-emitting layer should be at least 50%, preferably at least 80%, and more preferably at least 90% of the applied voltage. From the aforesaid expressions, it is thus found that:

$$\textit{for at least } 50\%,\ e1\geq 10\times d1 \quad (3)$$

$$\textit{for at least } 80\%,\ e1\geq 40\times d1 \quad (4)$$

$$\textit{for at least } 90\%,\ e1\geq 90\times d1 \quad (5)$$

In other words, the specific dielectric constant of the dielectric layer should be at least 10 times, preferably at least 40 times, and more preferably at least 90 times as large as the thickness of the dielectric layer as expressed in pm. For instance, if the thickness of the dielectric layer is 5 $\mu$m, the specific dielectric constant thereof should be at least 50, preferably at least 200, and more preferably at least 450.

For such a high-dielectric-constant material, various possible materials may be used. However, preference is given to (ferroelectric) dielectric materials containing lead as an constituting element because of their ease of synthesis and low-temperature formation capability. For instance, use is made of dielectric materials having perovskite structures such as $PbTiO_3$ and $Pb(Zr_xTi_{1-x})O_3$, composite perovskite-relaxor ferroelectric materials represented by $Pb(Mb_{1/3}Ni_{2/3})O_3$ or the like, and tungsten bronze ferroelectric materials represented by $PbNbO_6$ or the like. Among others, preference is given to ferroelectric materials having perovskite structures such as PZT, because they have a relatively high dielectric constant and are easily synthesized at relatively low temperatures due to the fact that the main constituting element lead oxide has a relatively low melting point of 890° C.

The aforesaid dielectric layer is formed by solution coating-and-firing processes such a sol-gel process and an MOD process. Generally, the sol-gel process refers to a film formation process wherein a given amount of water is added to a metal alkoxide dissolved in a solvent for hydrolysis and a polycondensation reaction, and the resultant precursor solution of a sol having an M—O—M bond is coated and fired on a substrate, and the MOD (metallo-organic decomposition) process refers to a film formation process wherein a metal salt of carboxylic acid having an M—O bond, etc. is dissolved in an organic solvent to prepare a precursor solution, and the obtained solution is coated and fired on a substrate. The precursor solution herein used is understood to mean a solution containing an intermediate compound produced in the film formation process such as the sol-gel or MOD process wherein the raw compound is dissolved in a solvent.

Generally, the sol-gel and MOD processes are used in combination, rather than used as perfectly separate processes. For instance, when a PZT film is formed, a solution is adjusted using lead acetate as a Pb source and alkoxides as Ti and Zr sources. In some cases, two such sol-gel and MOD processes are collectively called the sol-gel process. In the present disclosure, either process is referred to as the solution coating-and-firing process because a film is formed by coating and firing the precursor solution on a substrate. It is here noted that the dielectric precursor solution used herein includes a solution wherein dielectric particles of the order of sub-um are mixed with the precursor solution and the solution coating-and-firing process used herein includes a process wherein that solution is coated and fired on a substrate.

The solution coating-and-firing process, whether it is the sol-gel process or the MOD process, enables a dielectric material to be synthesized at a temperature much lower than that used for a method making essential use of the sintering of ceramic powders as in the case of forming a dielectric material by a thick-film process, because the dielectric forming element is uniformly mixed on the order of sub-$\mu$m or lower.

Taking PZT as an example, a high temperature of 900 to 1,000° C. or higher is needed for ordinary ceramic powder sintering processes; however, if the solution coating-and-firing process is used, it is then possible to form a film at a low temperature of about 500 to 700° C.

Thus, the formation of the dielectric layer by the solution coating-and-firing process makes it possible to use high heat-resistance glass, crystallized glass, green sheet glass or the like which could not have been used with conventional thick-film processes in view of heat resistance.

For the synthesis of lead-based dielectric ceramics, it is required to use the starting composition in excess of lead, as widely known in the art. To form a uniform lead-based dielectric material having satisfactory dielectric properties at low temperature using such a solution coating-and-firing process, an excess (of the order of a few % to 20%) of the lead component must be added to ceramics, as well known in the art.

In the case of the solution coating-and-firing process, the larger excess lead component is needed for prevention of reduced crystal growth due to the evaporation of the lead component during firing and the resulting lead deficiency as well as for the following possible reasons. Excessive lead of the lead component forms a low-melting composition portion which facilitates the diffusion of substance during crystal growth and makes reactions at low temperature possible; reactions occurring at temperatures lower than those for ordinary ceramics make an excessive lead component likely to be more entrapped in grown dielectric crystal grains as compared with ceramics; much more lead component is needed to maintain a sufficiently excessive lead state at each crystal growing site because the distance of diffusion of the excessive lead component is short; and so on.

The dielectric layer made up of the lead-based dielectric material to which the lead component is added in excess for such reasons is characterized in that it contains, in addition to the lead content incorporated in the crystal structure, a large excessive lead component in the state of lead oxide.

Such an excessive lead component precipitates easily from within the dielectric layer under thermal loads after the formation of the dielectric layer, especially thermal loads in a reducing atmosphere. Especially under the thermal loads in a reducing atmosphere, metal lead is likely to occur due to the reduction of lead oxide. If such a light-emitting layer as mentioned later is formed directly on this dielectric layer, there would then be a light emission luminance drops and considerable adverse influences on long-term reliability through the reaction of the light-emitting layer with the lead component and contamination of metal lead ions movable into the light-emitting layer.

In particular, the metal lead ions have high migration capability, and behave as movable ions in the light-emitting layer to which high electric fields are applied, producing some considerable influences on light emission properties and, hence, especially increased influences on long-term reliability.

Even when lead oxide is not reduced to metal lead by the reducing atmosphere in particular, the incorporation of the lead oxide component in the light-emitting layer causes lead oxide to be reduced by electron impacts due to high electric fields within the light-emitting layer with the result that the released metal ions have an adverse influence on reliability.

In addition to the lead-based dielectric layer formed by repeating the solution coating-and-firing process plural times, the thin-film EL device of the invention comprises a non-lead, high-dielectric-constant dielectric layer at least on its uppermost surface layer.

This non-lead, high-dielectric-constant dielectric layer makes it possible to reduce the diffusion of the lead component from the lead-based dielectric layer into the light-emitting layer and prevent the excessive lead component from having an adverse influence on the light-emitting layer.

The influence of the addition of this non-lead dielectric layer on the specific dielectric constant of the dielectric layer is now explained. Here let e3 and e4 represent the specific dielectric constants of the lead-based dielectric layer and non-lead dielectric layer, respectively, and d3 and d4 stand for the total thicknesses of the respective layers. Then, the effective specific dielectric constant e5 of the entire dielectric layer arrangement comprising the lead-based dielectric layer and non-lead dielectric layer is given by $$e5=e3\times 1/[1+(e3/e4)\times(d4/d3)] \quad (6)$$

In consideration of the relations between the specific dielectric constants of the aforesaid dielectric and light-emitting layers and the effective voltage applied to the light-emitting layer, the decrease in the effective specific dielectric constant of the composite lead-based dielectric/non-lead dielectric layer must be reduced as much as possible. Preferably, the specific dielectric constant of the composite layer should be at least 90%, and especially at least 95%, of that of a single dielectric layer. From expression (6), it is thus found that $$\text{for at least } 90\%,\ e3/d3\leq 9\times e4/d4 \quad (7)$$

$$\text{for at least } 95\%,\ e3/d3\leq 19\times e4/d4 \quad (8)$$

For instance, if the specific dielectric constant and thickness of the dielectric layer are assumed to be 1,000 and 8 μm, respectively, then the ratio of the specific dielectric constant and thickness of the non-lead dielectric layer should preferably be at least 1,125, and especially at least 2,375. Therefore, if the thickness of the non-lead dielectric layer is assumed to be 0.2 μm and 0.4 μm, then the specific dielectric constant should then be 225 to 475 or greater and 450 to 950 or greater, respectively.

For the purpose of preventing diffusion of lead, the thickness of the non-lead dielectric layer should preferably be as large as possible. According to the inventor's experimental studies, the thickness of the non-lead dielectric layer should be preferably at least 0.2 μm, and more preferably at least 0.4 μm. If no problem arises in conjunction with the decrease in the effective specific dielectric constant, then the non-lead dielectric layer is allowed to have a much larger thickness.

Even when the thickness of the non-lead dielectric layer is less than 0.2 μm, some effect on prevention of the diffusion of lead may be obtained. However, any satisfactory effect on prevention of the diffusion of lead is hardly obtained because of minute surface defects in the lead-based dielectric layer or the surface roughness thereof, or the local surface roughness of the non-lead dielectric layer due to the deposition of dust or the like ascribable to fabrication steps. This may otherwise result in a local decrease or deterioration in the luminance of the light-emitting layer due to the local diffusion of the lead component.

For this reason, the non-lead dielectric layer should preferably be as thick as possible and the specific dielectric constant required for the non-lead dielectric layer should evidently be preferably at least 50% of, and more preferably equivalent to, that of the lead-based dielectric layer. Accordingly, and in consideration of the fact that the specific dielectric constant necessary for the aforesaid dielectric layer should preferably be 50~200~450 or greater, the specific dielectric constant necessary for the non-lead dielectric layer should be at least 25, preferably at least 100, and more preferably at least 200.

As an example, consider the case where a 0.4 μm thick $Si_3N_4$ film having a specific dielectric constant of about 7 is formed in combination with a dielectric layer having a specific dielectric constant of 1,000 and a thickness of 8 μm. From expression (6), the effective specific dielectric constant is then found to be 122. Even when a 0.4 μm thick $Ta_2O_5$ film having a specific dielectric constant of about 25 is formed, the resultant effective specific dielectric constant becomes as low as 333. As a result, the effective voltage applied to the light-emitting layer drops largely. For this reason, the use of such a non-lead dielectric layer causes EL device drive voltage to become too high to obtain practical utility.

When a high-dielectric-constant material, e.g., a $TiO_2$ film having a specific dielectric constant of about 80 is formed at a thickness of 0.4 μm, on the other hand, a very high effective dielectric constant of 615 is obtained. If a substance having a specific dielectric constant of 200 is used, then an effective specific dielectric constant as high as 800 is obtained. The use of a substance having a specific dielectric constant of 500 makes it possible to achieve an effective specific dielectric constant of 910, which is substantially equivalent to that in the absence of any non-lead dielectric layer.

Perovskite structure dielectric materials such as $BaTiO_3$, $SrTiO_3$, $CaTiO_3$ and $BaSnO_3$ and their solid solutions are preferred for non-lead, high-dielectric-constant dielectric materials having a specific dielectric constant of 100 to 1,000 or greater, which exceeds about 80 that is the dielectric constant of $TiO_2$.

By use of the perovskite structure non-lead dielectric layer, it is thus possible to easily achieve the effect of the invention on prevention of the diffusion of the lead component into the light-emitting layer while the effective specific dielectric constant decrease is minimized.

In this connection, the inventor's studies have revealed that when such a perovskite structure non-lead dielectric layer is used, it is of importance that its composition is such that the ratio of A site atoms to B site atoms in the perovskite structure is at least 1.

To be more specific, all perovskite structure non-lead dielectric materials may crystallographically contain lead ions at the A site. Taking a $BaTiO_3$ composition as an example, consider the case where the starting composition for the formation of a $BaTiO_3$ layer is such that Ba that is the A site atom is deficient with respect to Ti that is the B site atom, as expressed by $Ba_{1-x}TiO_{3-x}$. Since an excessive lead component exists in the lead-based dielectric layer forming the $BaTiO_3$ layer, the Ba deficient site in the $BaTiO_3$ is easily replaced by the excessive lead component, yielding a $(Ba_{1-x}Pb_x)TiO_3$ layer. When a light-emitting layer is formed on the $BaTiO_3$ layer in such a state, no sufficient effect on prevention of the diffusion of lead is obtained because the light-emitting layer comes in direct contact with the lead component.

It is thus preferred that the composition of perovskite compound should be at least stoichiometric; however, it may be shifted to an A site excess side from the stoichiometric composition. As can be inferred from this explanation, even when the composition of the perovskite structure non-lead dielectric material is shifted to an A site excess side from the stoichiometric composition, there is a significant if remote possibility that the portion of the non-lead dielectric layer in the vicinity of the interface with respect to the lead-based dielectric layer may react with a part of the lead component, because the perovskite structure non-lead dielectric material may crystallographically be substituted by the lead component. For this reason, the non-lead dielectric layer should preferably have a certain or greater thickness. According to the inventor's experimental studies, this thickness should be 0.1 $\mu$m or greater, and preferably 0.2 $\mu$m or greater.

For the formation of the non-lead dielectric layer while its composition is under full control, it is preferable to make use of a sputtering process or the solution coating-and-firing process because the composition can be well controlled.

It is preferable to form the non-lead dielectric layer using the sputtering process, because a thin film having the same composition as the target composition can be easily formed, and a closely packed thin film having higher density and expected to produce a more enhanced effect on prevention of the diffusion of the lead component can be easily formed as well.

The solution coating-and-firing process is more preferred for the reasons that it is possible to form a dielectric layer whose composition is more severely controlled by control of the preparation ratio of the precursor solution as compared with the sputtering process; it is possible to allow the non-lead dielectric layer itself to have a defect correction effect that is the feature of the solution coating-and-firing process as will be described later; the solution coating-and-firing process is free from any surface roughness problem due to enhanced asperities on a substrate, which occur when a thick layer is formed by the sputtering process on the substrate; a thick layer can be easily formed; and the non-lead dielectric layer can be formed without recourse to any costly film formation equipment, viz., with equipment and steps similar to those for the lead-based dielectric layer.

The results of close studies by the inventor show that the aforesaid advantages are particularly outstanding under the following conditions.

The first condition is to provide the dielectric layer in the form of a composite structure comprising at least one lead-base dielectric layer and at least one non-lead, high-dielectric-constant dielectric layer, wherein at least the lead-based dielectric layer is formed by repeating the solution coating-and-firing process plural times, and at least the uppermost surface layer of the composite structure is made up of the non-lead, high-dielectric constant dielectric layer. With this structure, it is possible to prevent the excessive lead component of the lead-based dielectric layer from having an adverse influence on the light-emitting layer, as mentioned above.

When the lead-based dielectric layer is formed by repeating the solution coating-and-firing process plural times, especially at least three times, it is possible to bring the thickness of each dielectric sub-layer at a defective site due to dust or the like to at least ⅔ of the average thickness of the multilayer dielectric layer. Usually, a margin of about 50% of the predetermined applied voltage is allowed for the design value for the dielectric strength of a dielectric layer. Thus, a dielectric breakdown or other problem can be avoided even at a locally decreased dielectric strength site resulting from the aforesaid defects.

The second condition is to construct the non-lead dielectric layer of a high-dielectric-constant film, and most preferably a non-lead composition perovskite structure dielectric material which can easily have a specific dielectric constant of at least 100. By constructing the non-lead dielectric layer of such a high-dielectric-constant film, it is possible to prevent a decrease in the effective specific dielectric constant of the composite dielectric layer due to the inclusion of the non-lead dielectric layer. Most preferably, a perovskite structure, non-lead, high-dielectric-constant dielectric material is used as the high-dielectric-constant film, whereby the decrease in the effective specific dielectric constant of the dielectric layer can be minimized. Especially when the composition of the perovskite structure, non-lead, high-dielectric-constant layer is used, it is important to shift the composition from the stoichiometric ratio into an A site excess side. This makes it possible to achieve a perfect effect on prevention of the diffusion of the lead component into the light-emitting layer.

The third condition is to form the non-lead, high-dielectric-constant dielectric layer using the sputtering process or the solution coating-and-firing process. With the sputtering process, it is possible to form a high-density, closely packed, non-lead, high-dielectric-constant dielectric layer while its composition is easily controlled. With the solution coating-and-firing process, it is possible to easily form a thicker, non-lead, high-dielectric-constant dielectric layer free from any surface asperity problem while its composition is placed under more severe control. In addition, the effect on correction for defects occurring on each sub-layer due to dust or the like—which is the feature of the solution coating-and-firing process—is also expectable during the formation of the non-lead, high-dielectric-constant dielectric layer. By forming both the lead-based dielectric layer and the non-lead, high-dielectric-constant dielectric layer by repeating the solution coating-and-firing process a total of three or more times, it is thus possible to shirk a dielectric breakdown or other problem at a locally dielectric strength decreased site occurring through the aforesaid defects.

The fourth condition is to limit the thickness of the multilayer dielectric layer to 4 μm to 16 μm inclusive. The inventor's studies have revealed that the particle size of dust, etc. occurring at processing steps in an ordinary clean room, for the most part, is 0.1 to 2 μm, especially about 1 μm, and that by bringing the average thickness of the multilayer dielectric layer to at least 4 μm and especially at least 6 μm, it is possible to bring the dielectric strength of a defective portion of the dielectric layer due to dust or other defects to at least ⅔ of the average dielectric strength.

A thickness exceeding 16 μm results in cost increases because the number of repetition of the solution coating-and-firing process becomes too large. In addition, as the thickness of the dielectric layer increases, it is required to increase the specific dielectric constant per se of the dielectric layer, as can be understood from expressions (3) to (5). At a thickness of 16 μm or greater as an example, the required dielectric constant is 160~640~1,440 or greater. However, much technical difficulty is generally encountered in forming a dielectric layer having a dielectric constant of 1,500 or greater, using the solution coating-and-firing process. In the invention, on the other hand, it is easy to form a defect-free dielectric layer of high dielectric strength, and so it is unnecessary to form a dielectric layer having a thickness exceeding 16 μm. For these reasons, the upper limit to the thickness is 16 μm or less, and preferably 12 μm or less.

If the thickness of the dielectric layer is at least four times as large as the thickness of the lower electrode layer, it is also possible to make sufficient improvements in the coverage capability for pattern edges occurring by the patterning of the lower electrode layer and the surface flatness of the dielectric layer.

The only one requirement for the stack arrangement of the lead-based dielectric layer and non-lead, high-dielectric-constant dielectric layer in the invention is that the uppermost surface of the arrangement be composed of the non-lead, high-dielectric-constant dielectric layer. Such arrangements may be alternately stacked one upon another and the uppermost surface of the uppermost arrangement may be composed of a non-lead, high-dielectric-constant dielectric layer. With such a stack arrangement, the diffusion of the excessive lead component in the lead-based dielectric layers is effectively prevented by the alternately stacked non-lead, high-dielectric-constant dialectic layers, so that the effect of the uppermost non-lead, high-dielectric-constant dielectric layer on prevention of the diffusion of the lead component is much more enhanced. This stack arrangement is advantageous for the non-lead, high-dielectric-constant dielectric layer formed by the sputtering process in particular; it is effective to avoid a noticeable surface asperity problem associated with the sputtering process, which arises when a thick layer is formed thereby.

It is here appreciated that the respective sub-layers of the lead-based dielectric layer may be formed with equal or different thicknesses, and may be made up of identical or different materials. The non-lead, high-dielectric-constant dielectric layer may be made up of a plurality of materials.

Figure 5:
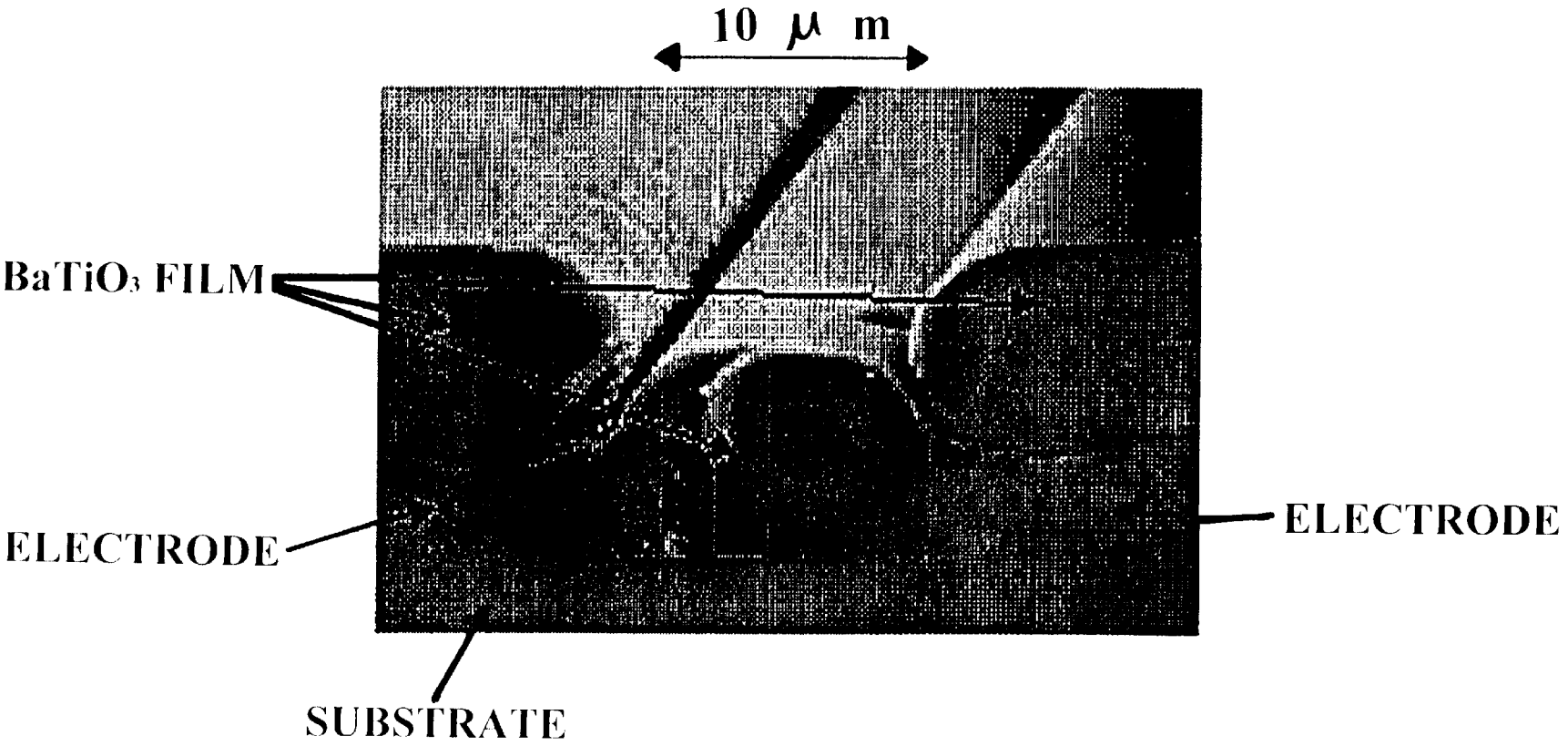
FIG. 5 PRIOR ART
FIG. 5 is an electron microscope photograph illustrative in section of a prior art thin-film EL device.

For a better understanding of the advantages of the invention, the case where the lead-based dielectric layer is formed by repeating the solution coating-and-firing process of the invention plural times and a dielectric layer formed by the sputtering process, rather than the non-lead, high-dielectric-constant dielectric layer, is provided on at least uppermost surface of the lead-based dielectric layer is now explained with reference to an electron microscope photograph. FIG. 5 is an electron microscope photograph of the case where an 8 μm thick $BaTiO_3$ thin film is formed by sputtering on a substrate on which a 3 μm thick lower electrode layer was formed and patterned. As can be seen from FIG. 5, when the dielectric layer is provided by sputtering, the surface of the dielectric film is formed with steps enhanced on the substrate and, hence, there are noticeable asperities and overhangs on the surface thereof. A similar asperity phenomenon on the surface of the dielectric layer is also found when the dielectric layer is formed by an evaporation process, not by the sputtering process. A functional thin film like an EL light-emitting layer cannot possibly be formed and used on such a dielectric layer. Defects inevitably associated with a dielectric layer formed by a conventional process such as a sputtering process and caused by steps on the lower electrode layer, dust or the like can be perfectly covered up by repeating the solution coating-and-firing process of the invention, whereby a dielectric layer having a flattened surface can be obtained.

For the light-emitting layer material, known materials such as the aforesaid ZnS doped with Mn may be used although the invention is not particularly limited thereto. Among these, SrS: Ce is particularly preferred because improved properties are achievable. No particular limitation is imposed on the thickness of the light-emitting layer; however, too large a thickness leads to a driving voltage rise whereas too small a thickness causes a light emission luminance drop. By way of example but not by way of limitation, the light-emitting layer should preferably have a thickness of the order of 100 to 2,000 nm although varying with the light-emitting material used.

The light-emitting layer may be formed by vapor phase deposition processes, among which physical vapor phase deposition processes such as sputtering and evaporation and chemical vapor phase deposition processes such as CVD are preferred. Especially when the light-emitting layer is formed of the aforesaid SrS:Ce, it is possible to obtain a light-emitting layer of high purity by making use of an electron beam evaporation process in a $H_2S$ atmosphere while the substrate is held at a temperature of 500° C. to 600° C. during film formation.

After the light-emitting is formed, it should preferably be treated by heating. This heat treatment may be carried out after the electrode, dielectric layer and light-emitting layer are stacked on the substrate in this order or, alternatively, carried out (by cap annealing) after the electrode layer, dielectric layer, light-emitting layer and insulator layer are stacked, optionally with an electrode layer, on the substrate in this order. Although depending on the light-emitting layer, the heat treatment for SrS:Ce should be carried out at a temperature of 500° C. to 600° C. or higher to the firing temperature of the dielectric layer for 10 to 600 minutes. For the heat treatment atmosphere, Ar is preferred.

For the formation of a light-emitting layer taking full advantage of SrS:Ce or the like, film formation should be carried out at a high temperature of 500° C. or higher in a vacuum or reducing atmosphere, and the high-temperature thermal treatment step should then be carried out under atmospheric pressure. With the prior art, problems such as the reaction of the lead component in the dielectric layer with the light-emitting layer and the diffusion of lead are thus unavoidable. However, the thin-film EL device of the invention can perfectly prevent the adverse influences of the lead component on the light-emitting layer, and so has a great advantage over the prior art.

The light-emitting layer should preferably have a thin-film insulator layer(s) formed thereon, although the insulator layers 17 and/or 15 may be dispensed with as mentioned above. The thin-film insulator layer should have a resistivity of at least $10^8$ Ω·cm, and preferably about $10^{10}$ to $10^{18}$ Ω·cm, and be preferably made up of a material having a relatively high dielectric constant of ϵ=ca. 3 or greater. The thin-film insulator layer, for instance, may be made up of silicon oxide ($SiO_2$), silicon nitride (SiN), tantalum oxide ($Ta_2O_5$), yttrium oxide ($Y_2O_3$), zirconia ($ZrO_2$), silicon oxynitride (SiON), and alumina ($Al_2O_3$). The thin-film insulator layer may be formed by sputtering, evaporation or like processes. It is then preferred that the thin-film insulator layer have a thickness of 50 to 1,000 nm, and especially about 50 to 200 nm.

The transparent electrode layer may be made up of oxide conductive materials such as ITO, $SnO_2$ (Nesa film) and ZnO—Al of 0.2 μm to 1 μm in thickness, and formed by known techniques such as sputtering as well as evaporation techniques.

While the aforesaid thin-film EL device has been described as having a single light-emitting layer, it is appreciated that the thin-film EL device of the invention is not limited to such construction. For instance, a plurality of light-emitting layers may be stacked in the thickness direction or, alternatively, a matrix combination of different types of light-emitting layers (pixels) may be arranged on a plane.

The thin-film EL device of the invention may be easily identified by observation under an electron microscope. That is, it is seen that the dielectric layer formed by the repetition of the solution coating-and-firing process of the invention is not only in a multilayer form unlike a dielectric layer formed by other processes but is also different in quality therefrom. In addition, this dielectric layer has another feature of very excellent surface smoothness.

As already explained, the thin-film EL device of the invention allows high-performance, high-definition displays to be easily set up because the dielectric layer, on which the light-emitting layer is to be stacked, is of very excellent surface smoothness and high dielectric strength, and is free form any defect as well, and because damage to the light-emitting layer by the excessive lead component of the dielectric layer—which has so far been a problem with the prior art—can be prevented altogether. Furthermore, the thin-film EL device of the invention is so easy to fabricate that fabrication costs can be cut down.

EXAMPLE

The present invention is now explained more specifically with reference to examples.

A 1 μm thick Au thin film with trace additives added thereto was formed by sputtering on a surface polished alumina substrate of 99.6% purity, and heat treated at 700° C. for stabilization. Using a photoetching process, this Au thin film was patterned in a striped arrangement comprising a number of stripes having a width of 300 μm and a space of 30 μm.

A dielectric layer, i.e., a PZT dielectric layer was formed on the substrate using the solution coating-and-firing process. The dielectric layer was formed by repeating given times the solution coating-and-firing process wherein a sol-gel solution prepared as mentioned below was spin coated as a PZT precursor solution on the substrate and fired at 700° C. for 15 minutes.

To prepare a basic sol-gel solution, 8.49 grams of lead acetate trihydrate and 4.17 grams of 1,3-propanediol were heated under agitation for about 2 hours to obtain a transparent solution. Apart from this, 3.70 grams of a 70 wt% 1-propanol solution of zirconium normal propoxide and 1.58 grams of acetylacetone were heated under agitation in a dry nitrogenatmosphere for 30 minutes to obtain a solution, which was then heated under agitation for a further 2 hours, with the addition thereto of 3.14 grams of a 75 wt% 2-propanol solution of titanium.diisopropoxide.bisacetyl acetonate and 2.32 grams of 1,3-propanediol. Two such solutions were mixed together at 80° C., and the resultant mixture was heated under agitation for 2 hours in a dry nitrogen atmosphere to prepare a brown transparent solution. This solution, after held at 130° C. for a few minutes to remove by-products therefrom, was heated under agitation for a further three hours, thereby preparing a PZT precursor solution.

The viscosity of the sol-gel solution was regulated by dilution with n-propanol. By control of the spin coating conditions and the viscosity of the sol-gel solution, the thickness of each sub-layer in the dielectric layer was regulated to 0.7 μm. The PZT layer formed under this condition contained the lead component in an about 10% excess of the stoichiometric composition.

By repeating the spin coating and firing of the aforesaid sol-gel solution as the PZT precursor solution ten times, a lead-based dielectric layer of 7 μm in thickness was formed. This PZT film was found to have a specific dielectric constant of 600.

For the non-lead, high-dielectric-constant dielectric layer, a $BaTiO_3$ film was formed on the lead-based dielectric layer by the solution coating-and-firing process. In addition, a $BaTiO_3$ film, an $SrTiO_3$ film, and a $TiO_2$ film was formed on the lead-based dielectric layer by the sputtering process. In this way, samples were obtained. For the purpose of comparison, a sample was prepared without recourse of any non-lead, high-dielectric-constant dielectric layer.

The $BaTiO_3$ thin film was formed at an Ar gas pressure of 4 Pa and a 13.56 MHz high-frequency electrode density of $2W/cm^2$, using a magnetron sputtering system wherein a $BaTiO_3$ ceramic material was used as a target. The then film deposition rate was about 5 nm/min., and a thickness of 50 nm to 400 nm was obtained by control of the sputtering time. The thus formed $BaTiO_3$ thin film was in an amorphous state, and the heat treatment of this film at 700° C. gave a specific dielectric constant of 500. By X-ray diffractometry, the heat-treated $BaTiO_3$ thin film was identified to have a perovskite structure. The composition of this $BaTiO_3$ thin film contained Ba in a 5% excess of the stoichiometric composition.

The $SrTiO_3$ thin film was formed at an Ar gas pressure of 4 Pa and a 13.56 MHz high-frequency electrode density of 2 $W/cm^2$, using a magnetron sputtering system wherein an $SrTiO_3$ ceramic material was used as a target. The then film deposition rate was about 4 nm/min., and a thickness of 400 nm was obtained by control of the sputtering time. The thus formed $SrTiO_3$ thin film was in an amorphous state, and the heat treatment of this film at 700° C. gave a specific dielectric constant of 250. By X-ray diffractometry, the $SrTiO_3$ thin film heat treated at a temperature higher than 500° C. was identified to have a perovskite structure. The composition of this $SrTiO_3$ thin film contained Sr in an 3% excess of the stoichiometric composition.

The $TiO_2$ thin film was formed at an Ar gas pressure of 1 Pa and a 13.56 MHz high-frequency electrode density of 2 $W/cm^2$, using a magnetron sputtering system wherein a $TiO_2$ ceramic material was used as a target. The then film deposition rate was about 2 nm/min., and a thickness of 400 nm was obtained by control of the sputtering time. The heat treatment of this film at 600° C. gave a specific dielectric constant of 76.

The $BaTiO_3$ film by the solution coating-and-firing process was formed by repeating given times a process wherein a sol-gel solution prepared as mentioned below was spin coated as a $BaTiO_3$ precursor solution on a substrate, then heated to a maximum temperature of 700° C. at an incremental heating rate of 200° C., and finally fired at the maximum temperature for 10 minutes.

To prepare the $BaTiO_3$ precursor solution, PVP (polyvinyl pyrrolidone) having a molecular weight of 630,000 was completely dissolved in 2-propanol, and acetic acid and titanium tetraisopropoxide were added to the resulting solution under agitation, thereby obtaining a transparent solution. A mixed solution of pure water and barium acetate was added dropwise to this transparent solution under agitation. While stirring was continued in this state, the resultant solution was aged for a given time. The composition ratio for the respective starting materials was barium acetate:titanium tetraisopropoxide:PVP:acetic acid:pure water:2-propanol= 1:1:0.5:9:20:20. In this way, the $BaTiO_3$ precursor solution was obtained.

The coating and firing of the aforesaid $BaTiO_3$ precursor solution was carried out once, and twice, thereby obtaining a $BaTiO_3$ dielectric layer of 0.5 $\mu$m, and 1.0 $\mu$m in thickness, respectively. This film had a specific dielectric constant of 380 and a composition in coincidence with the stoichiometric composition.

The substrate on which the lead-based dielectric layer and non-lead, high-dielectric-constant dielectric layer were stacked was provided thereon with a light-emitting layer of SrS:Ce by means of an electron beam evaporation process while the substrate was held at a temperature of 500° C. in a $H_2S$ atmosphere for film formation. The light-emitting layer was then heat treated at 600° C. for 30 minutes in a vacuum.

Then, the light-emitting layer was successively provided thereon with an $Si_3N_4$ thin film as an insulator layer and an ITO thin film as an upper electrode layer by means of sputtering, thereby obtaining a thin-film EL device. In this case, the upper electrode layer of ITO thin film was formed according to a pattern comprising stripes of 1 mm in width, using a metal mask. The light emission properties of the obtained device structure were measured with the application of an electric field at which the light emission luminance was saturated at a pulse width of 50 $\mu$s at 1 kHz while electrodes were led out of the lower electrode and upper transparent electrode.

The properties to evaluate were light emission threshold voltage, saturated luminance, and deterioration in the luminance reached after 100 hour-continuous light emission. The non-lead, high-dielectric-constant dielectric layers in Table 1, e.g., SP-$BaTiO_3$ and SOL-$BaTiO_3$, are understood to mean $BaTiO_3$ formed by the sputtering and solution coating-and-firing processes, respectively.

TABLE 1

| | Lead-Based Dielectric | | Non-Lead High-Dielectric Constant Dielectric | | Light-Emission | Luminance | |
|---|---|---|---|---|---|---|---|
| Sample | Layer | Thickness | Layer | Thickness | Voltage | Reached | Deterioration |
| 1* | PZT | 7 $\mu$m | — | — | 170 V | 500 cd | 50% |
| 2** | PZT | 7 $\mu$m | SP-$BaTiO_3$ | 0.05 $\mu$m | 150 V | 550 cd | 40% |
| 3** | PZT | 7 $\mu$m | SP-$BaTiO_3$ | 0.1 $\mu$m | 145 V | 890 cd | 14% |
| 4** | PZT | 7 $\mu$m | SP-$BaTiO_3$ | 0.2 $\mu$m | 140 V | 1120 cd | 5% |
| 5** | PZT | 7 $\mu$m | SP-$BaTiO_3$ | 0.4 $\mu$m | 142 V | 1230 cd | 5% |
| 6** | PZT | 7 $\mu$m | SP-$SrTiO_3$ | 0.4 $\mu$m | 144 V | 1200 cd | 6% |
| 7** | PZT | 7 $\mu$m | SP-$TiO_2$ | 0.4 $\mu$m | 150 V | 1050 cd | 20% |
| 8** | PZT | 7 $\mu$m | SOL-$BaTiO_3$ | 0.5 $\mu$m | 143 V | 1200 cd | 5% |
| 9** | PZT | 7 $\mu$m | SOL-$BaTiO_3$ | 1.0 $\mu$m | 146 V | 1220 cd | 4% |

*comparative
**inventive

As a result, the comparative example free from the non-lead, high-dielectric-constant dielectric layer showed a luminance deterioration of as large as 50%, and the samples containing the $BaTiO_3$ layer formed by the sputtering process according to the invention had a luminance reached of about 1,200 cd at a thickness of 0.2 $\mu$m or greater and a light emission threshold voltage of about 140 V, with only limited luminance deterioration. At less than 0.1 $\mu$m, on the other hand, the light emission threshold voltage increased with a decreasing luminance reached, resulting in further considerable luminance deterioration. The $SrTiO_3$ layer gave much the same properties as in the case of the $BaTiO_3$ layer having the same thickness, although there was a slight light emission threshold voltage increase. The $BaTiO_3$ layer formed by the solution coating-and-firing process, too, gave much the same properties as in the case of the dielectric layers obtained by sputtering, although there was a slight light emission threshold increase.

The $TiO_2$ film was higher in threshold voltage and lower in luminance than the $BaTiO_3$ film having the same thickness, with some remarkable luminance deterioration.

In the comparative structure composed only of PZT, there were light emission threshold increases as well as luminance decreases with considerable luminance deterioration. In addition, a dielectric breakdown was often found at an applied voltage in the vicinity of the luminance reached.

As can be seen from these results, the structure using the non-lead, high-dielectric-constant perovskite layer as the non-lead, high-dielectric constant layer started to show its effect at a thickness of at least 0.1 $\mu$m, and exhibited a remarkable light emission luminance increase, a significant threshold voltage drop, and reliability improvements especially at 0.2 μm or greater.

This reveals that the diffusion of the lead component in the lead-based dielectric layer into the light-emitting layer is effectively prevented.

The $TiO_2$ layer was lower in saturated luminance, higher in light emission threshold voltage and more significant in luminance deterioration than the perovskite layer, although it was found to have a certain effect as a reaction preventive layer. This is believed to be probably because the $TiO_2$ film was partly placed in a $PbTiO_3$ state through the reaction with the excessive lead in the PZT layer, and so could not perfectly function as a reaction preventive layer.

ADVANTAGES OF THE INVENTION

The advantages of the invention can be understood from the foregoing. According to the invention, the defects occurring in the dielectric layer—which are one problem associated with the prior art—can be eliminated. In particular, a solution can be provided to problems in conjunction with the light emission luminance drops, luminance variations, and changes of light emission luminance with time of a thin-film EL device wherein the multilayer dielectric layer is constructed using the solution coating-and-firing process. It is thus possible to provide, without incurring any added cost, a thin-film EL device capable of presenting displays of high quality, and a process for the fabrication of the same.

What we claim is:

1. A thin-film EL device having at least a structure comprising an electrically insulating substrate, a patterned electrode layer stacked on said substrate, and a dielectric layer, a light-emitting layer and a transparent electrode stacked on said electrode layer, wherein:

said dielectric layer has a multilayer structure wherein at least one lead-based dielectric layer formed by repeating a solution coating-and-firing process once or more times and at least one non-lead, high-dielectric-constant layer are stacked together, and at least an uppermost surface layer of said dielectric layer having said multilayer structure is defined by a non-lead, high-dielectric-constant dielectric layer.

2. The thin-film EL device according to claim 1, wherein said lead-based dielectric layer has a thickness of 4 μm to 16 μm inclusive.

3. The thin-film EL device according to claim 1, wherein said non-lead, high-dielectric-constant dielectric layer is made up of a perovskite structure dielectric material.

4. The thin-film EL device according to claim 1, wherein said non-lead, high-dielectric-constant dielectric layer is formed by a sputtering process.

5. The thin-film EL device according to claim 1, wherein said non-lead, high-dielectric-constant dielectric layer is formed by the solution coating-and-firing process.

6. The thin-film EL device according to claim 1, wherein said dielectric layer having said multilayer structure is formed by repeating the solution coating-and-firing process at least three times.

7. A process for fabricating the thin-film EL device according to claim 1, wherein:

at least one lead-based dielectric layer formed by repeating a solution coating-and-firing process once or more times and at least one non-lead, high-dielectric-constant dielectric layer are stacked together to form a multilayer structure, and at least an uppermost surface layer of a dielectric layer having said multilayer structure is defined by a non-lead, high-dielectric-constant dielectric layer.

8. The thin-film EL device fabrication process according to claim 7, wherein said non-lead, high-dielectric-constant dielectric layer is formed by a sputtering process.

9. The thin-film EL device fabrication process according to claim 7, wherein said non-lead, high-dielectric-constant dielectric layer is formed by the solution coating-and-firing process.

10. The thin-film EL device fabrication process according to claim 7, wherein said dielectric layer having said multilayer structure is formed by repeating the solution coating-and-firing process at least three times.

* * * * *

UNITED STATES PATENT AND TRADEMARK OFFICE

CERTIFICATE OF CORRECTION

PATENT NO. : 6,577,059 B2 
DATED : June 10, 2003
INVENTOR(S) : Yukihiko Shirakawa et al.

It is certified that error appears in the above-identified patent and that said Letters Patent is hereby corrected as shown below:

Title page,
Item [75], Inventors, "Yukihiko Shirakawa, Chuo-ku (JP);
Masashi Miwa, Chuo-ku (JP);
Katsuto Nagano, Chuo-ku (JP)" should read
-- Yukihiko Shirakawa, Tokyo (JP);
Masashi Miwa, Tokyo (JP);
Katsuto Nagano, Tokyo (JP) --.

Signed and Sealed this

Sixth Day of January, 2004

JAMES E. ROGAN
*Director of the United States Patent and Trademark Office*